US009868566B2

(12) United States Patent
Hartwig

(10) Patent No.: US 9,868,566 B2
(45) Date of Patent: Jan. 16, 2018

(54) SECONDARY PACKAGING COMPRISING MULTIPLE PRIMARY PACKAGING SIZES

(75) Inventor: Klaus Hartwig, Nancy (FR)

(73) Assignee: Nestec S.A., Vevey (CH)

( * ) Notice: Subject to any disclaimer, the term of this patent is extended or adjusted under 35 U.S.C. 154(b) by 412 days.

(21) Appl. No.: 13/992,958

(22) PCT Filed: Dec. 7, 2011

(86) PCT No.: PCT/EP2011/072013

§ 371 (c)(1),
(2), (4) Date: Jun. 10, 2013

(87) PCT Pub. No.: WO2012/076577

PCT Pub. Date: Jun. 14, 2012

(65) Prior Publication Data

US 2013/0248397 A1 Sep. 26, 2013

(30) Foreign Application Priority Data

Dec. 10, 2010 (EP) ..... 10194566

(51) Int. Cl.

| | |
|---|---|
| ***B65D 21/02*** | (2006.01) |
| ***B65D 71/00*** | (2006.01) |
| ***B65D 71/02*** | (2006.01) |
| ***B65D 71/08*** | (2006.01) |

(52) U.S. Cl.

CPC ..... *B65D 21/02* (2013.01); *B65D 21/0204* (2013.01); *B65D 21/0231* (2013.01); *B65D 71/00* (2013.01); *B65D 71/02* (2013.01); *B65D 71/08* (2013.01)

(58) Field of Classification Search

CPC B65D 21/0204; B65D 21/0237; B65D 21/02; B65D 21/0231; B65D 71/00; B65D 71/02; B65D 71/08

USPC ..... 206/432, 427, 548, 597, 504, 509; 220/23.4, 23.86, 756, 770; 215/10

See application file for complete search history.

(56) References Cited

U.S. PATENT DOCUMENTS

| | | | | |
|---|---|---|---|---|
| 3,374,917 A | | 3/1968 | Troy | |
| 3,658,204 A | * | 4/1972 | Bottger | 220/23.4 |
| 4,235,343 A | * | 11/1980 | Thompson | 215/6 |
| 4,640,423 A | * | 2/1987 | Mednis | B65D 1/02 206/504 |
| 5,022,547 A | * | 6/1991 | Spangler et al. | 220/23.4 |
| 5,310,071 A | | 5/1994 | Rivlin et al. | |

(Continued)

FOREIGN PATENT DOCUMENTS

| | | |
|---|---|---|
| CN | 101959763 | 1/2011 |
| EP | 2096040 | 9/2009 |

(Continued)

*Primary Examiner* — Chun Cheung
(74) *Attorney, Agent, or Firm* — K&L Gates LLP

(57) ABSTRACT

The invention relates to a composite package (8) linked together into a single unit, and comprising a plurality of individual containers (1, 2, and 3) of varying shapes and/or volumes and being assembled according to different orientations in the composite package. In the composite package are defined strong and weak containers according to their mechanical resistances on which apply external loads. According to the invention, the strong containers are arranged in their orientation along the direction(s) of external loads placed upon the composite package thereby protecting the weakest ones.

6 Claims, 7 Drawing Sheets

(56) References Cited

U.S. PATENT DOCUMENTS

| | | | | |
|---|---|---|---|---|
| 5,316,159 | A * | 5/1994 | Douglas et al. | 215/10 |
| 6,206,218 | B1 * | 3/2001 | Young et al. | 220/23.4 |
| 2009/0194436 | A1 | 8/2009 | Bates | |

FOREIGN PATENT DOCUMENTS

| | | |
|---|---|---|
| GB | 361962 | 11/1931 |
| WO | 2010065307 | 6/2010 |
| WO | 2011020128 | 2/2011 |

* cited by examiner

SECONDARY PACKAGING COMPRISING MULTIPLE PRIMARY PACKAGING SIZES

CROSS REFERENCE TO RELATED APPLICATIONS

The present application is a National Stage of International Application No. PCT/EP2011/072013, filed on Dec. 7, 2011, which claims priority to European Patent Application No. 10194566.5, filed Dec. 10, 2010, the entire contents of which are being incorporated herein by reference.

FIELD OF THE INVENTION

The present invention relates to the field of packaging beverage containers in multi-unit bundles. The invention more particularly relates to the practice of configuring multi-unit bundles to meet the consumption patterns of the consumer. The invention also relates to an arrangement of a plurality of such bundles upon a pallet or stack.

BACKGROUND OF THE INVENTION

For many years, it has been known to provide food and drink products in containers of different sizes. For example, one may purchase a beverage in a large container for use at home, or in a smaller size for sport or travel, or in a size smaller still for consumption by a child at school. By selecting a container size or sizes appropriate to their needs, the consumer may tailor their purchase of the product to his/her need. Such containers may include bottles, cans, boxes, jars, canisters, and the like.

It has also been known for many years to distribute or sell containers in multi-unit bundles. Such bundles are generally simple groupings of a plurality of identical containers, which may optionally be provided with a handle or other means for manipulating and transporting the bundle with greater ease. In a common embodiment of the prior art, six 1.5 L plastic bottles of mineral water are arranged in a 2×3 array, bundled together with heat-shrinking plastic, and provided with a foam rubber or plastic handle that is attached with adhesive. The bundling of containers in this fashion allows the consumer to purchase multiple containers of the product with greater ease. Furthermore, retailers often price the multi-container bundles below the price of an equivalent number of individually-purchased containers bearing an equivalent amount of product, resulting in a cost savings for the consumer.

The present method of bundling containers is disadvantageous, however, in that the bundles consist of containers that are all of the same size and capacity. Thus, in order to purchase different sizes of containers for different uses (i.e. home, travel, school, etc.) one must either purchase multiple bundles of different-sized containers, or purchase different-sized containers individually. This often results in the consumer purchasing quantities of each size of container that are either too large or too small, as a consumer may not consume differently-sized containers at the same rate. Thus, the consumer is either forced to purchase individual containers or purchase extra bundles of the required size of container to make up the difference. This results in the generation of extra waste and greater expenditures for the consumer.

The present method is also disadvantageous in that the containers within the bundle are generally oriented such that the bundle is resistant to external forces and loads applied only in one general direction. This is disadvantageous in that, in order to make the bundles strong enough to be manipulated, shipped, stacked, carried, etc, the individual containers must be made thicker, or the bundle disposed of some means for bracing its structure or otherwise holding it together. This makes the bundles more expensive to assemble and transport and creates greater waste when the bundles and containers are discarded.

European Patent Application EP2096040 A1 attempts to provide an arrangement or stack of containers with increased strength and resistance to loading. EP 2096040 A1 is directed to a beverage container that is provided with a neck which is tilted or off-center, and a coordinating flattened, rounded, or recessed portion on the body of the container. According to this document, a plurality of beverage containers so configured may be positioned upon each other in layers, interlocking to form a stack that is resistant to loads applied from both the top and the sides. However, this is insufficient for application to a composite package of individual containers of varying sizes, since all of the containers in the stack must be of identical size and shape. Furthermore, the containers must be loose, i.e. not bundled, in order for the advantageous load resistance properties to be achieved. The invention described in European Patent Application EP2096040 A1 is thus not sufficient to ameliorate the faults in the existing prior art.

SUMMARY OF THE INVENTION

It is accordingly an object of the invention to provide a means by which the packaging of a product is more closely aligned with the consumer's consumption patterns of that product, with the result that the quantity of each particular size of container in a composite package or bundle is coordinate with the consumer's consumption of that particular size container.

Another object of the invention is to provide a means by which external loads exerted upon the composite package or bundle, as well as the weight of the containers themselves, are borne in such a way that the loading upon the containers is optimized with respect to the properties of the containers; their orientation in the composite package and of the composite package as a whole.

Another object of the invention is to provide means for interlocking of individual containers in the composite package or bundle, thereby strengthening the composite package.

Another object of the invention is to provide means for interlocking of a plurality of composite packages or bundles, such as when piled upon a shelf or pallet.

According to a first aspect, this invention is directed to a composite package as described in Claim 1. This composite package is advantageous in that it makes accommodation for a family's consumption pattern of a beverage or other substance. This advantage is brought by the presence of containers of different shapes and/or volumes (or sizes). This permits the shopper to select an appropriate composite package from a shelf, purchase it as a unit, and be assured that the packaging and total amount of the product he/she has purchased is appropriate to the consumption patterns of his/her household. This is also advantageous in that the consumer need not purchase extra containers of a particular size or be left with a surplus of a particular size of container. Furthermore, the composite package may have a compact shape which provides better storage possibility at home. Such a composite package needs less available storage room at home than in the prior art.

The way the containers are arranged in the package, in particular their varied orientations, provides technical advantages. As a matter of fact, individual containers are arranged so that different containers bear different elements of an external load placed upon the composite package, according to their orientation within the composite package.

For instance, weak and strong containers (from a mechanical resistance point of view) may be combined in an appropriate manner within the same package and especially by arranging them according to different orientations in the composite package.

By suitably orienting the containers the strongest ones may be arranged to receive external loads applied to the package, thereby protecting the weakest ones. Indeed, orienting the strong containers along the direction(s) of external loads placed upon the composite package provides a base structure of the composite package which then can to be filled with less resisting containers so that the weakest containers are protected by the strongest ones.

For convenience, the composite package comprises a plurality of individual containers linked together into a single unit and arranging containers of varying shapes and/or volumes and/or orientations within the composite package makes it possible to make the package smaller and more compact for the same amount of product(s).

In particular, use is now made of the previously free space between containers (e.g. bottles) for adding other containers with varying shapes and/or volumes and/or orientations.

By way of example, within the volume occupied by a prior art package containing six 1.5 liter bottles the present invention makes it possible to have up to 20% more product (s).

According to another aspect of the invention, the composite package comprises a packaging material as defined in Claim 2. More particularly, the composite package is held together by a packaging material such as straps, cord, rope, twine, paper, plastic film, or other suitable packaging material that binds the individual containers together into a single unit. This is advantageous in that the packaging material binds the containers into a single unit that is easily handled, transported, and stored. This is also advantageous in that combining the individual containers into a single, bound unit reduces pilferage and allows the retailer to price the composite package as a single item.

According to another aspect of the invention, the individual containers that form the composite package are arranged so that different containers bear different directional elements or components of an external load placed upon the composite package, according to their orientation within the composite package. For example, some containers are oriented vertically within the composite package to bear laterally-applied loads, while other containers may be oriented horizontally to bear vertical loadings upon the composite package. The individual containers may also be arranged so that loadings are not applied to the containers at points that contain stress concentrators, such as necks. This is advantageous in that since the composite packages so constructed are thus stronger than those found in the prior art, the individual containers constituting the packages may be made lighter and with less material. This results in greater economy in fabricating and shipping the containers and composite packaging, as well as less waste to be disposed of by the consumer once the product has been consumed.

According to another aspect of the invention, the weight of at least some of the individual containers within the composite package is borne by other individual containers within the same composite package. This is advantageous in that some of the individual containers themselves serve as structural support for the other individual containers within the composite package, requiring less material to achieve a sufficient structural integrity in the composite package.

According to another aspect of this invention, at least some of the individual containers that make up the composite package are provided with interlocking means, so that when positioned within the composite package the individual containers are held together, thereby preventing, or at least reducing, relative motion between these individuals containers. This is advantageous in that it lends the composite package enhanced structural integrity without necessitating the use of additional packaging or structural materials.

According to another aspect of the invention, interlocking means comprise male and female interlocking members. Further, at least some of the individual containers in the composite package may be provided both with male and female interlocking members. Thus, a first container may include both a male interlocking member to be engaged with the female interlocking member of a second container, and a female interlocking member to be engaged with the male interlocking member of a third container. This is advantageous in that by locking at least some of the individual containers together, the composite package achieves structural strength and rigidity that would otherwise have to be provided by additional structural elements such as bindings, bracing, and the like. This is also advantageous in that any structural elements that are used, such as a plastic film wrapping, may be made thinner and lighter as their contribution to the overall structural integrity and rigidity of the composite package is reduced. This aspect thus reduces the cost of and waste produced by the composite packaging.

According to another aspect of the invention, at least some of the individual containers are provided each with a cap, which plays the role of the male interlocking member, and at least one recess, which plays the role of a female locking member. This is advantageous in that the advantages of providing the containers with interlocking members may be achieved without adding extraneous structures or materials to the individual containers or the composite package. This is because a closure such as a cap is generally a requisite part of a container, and because a recess may be incorporated into the body of a container, such as during the process of fabricating the container.

According to another aspect of the invention which may be independent from the previous aspects, one or some of the containers, e.g. bottles, in a composite package may be provided with a closing cap whereas the other containers are merely sealed by a foil, a film, a pellicule, etc.

The cap of the container(s) thus equipped may be used for the other non-equipped containers after removing the sealing cover (foil, etc.) once the former container(s) have been emptied.

According to another aspect of the invention, the individual containers are interlocked within the composite package along at least two different directions or axes. For instance, one container is configured so as to interlock with another container along one axis, while simultaneously interlocking with a third container along a second axis substantially perpendicular to the first axis. This is advantageous in that with each additional axis of interlocking, the composite package is given additional structural integrity and resistance to loadings perpendicular to that axis. By combining interlocks along perpendicular axes, the composite package is thus given structural integrity along numerous axes. It is to be noted that axis of interlocking may coincide with axis of orientation of individual containers within a composite package.

According to another aspect of the invention, the interlocked individual containers are configured so as to enclose or delimit an interstitial space within the composite package. This interstitial space may be used to enclose further individual containers, or other items to be sold as a part of the composite package. This is advantageous in that the presence of the interstitial space allows the manufacturer opportunity to include products that would be appropriate as a part of the composite package but whose packaging may not be appropriate for inclusion in the group of interlocked individual containers. More particularly, the composite package is as defined in claim 11.

Another aspect of this invention is a composite package as defined in Claim 12. More particularly, the composite packages are constructed so that the individual containers that constitute them are disposed so as to provide a means for the interlocking of multiple such composite packages. For instance, the composite packages may be configured so that each one engages another composite package above, below, or to any or all of its lateral sides; or any combination thereof. This engagement increases the stiffness of an assembly, arrangement or stack of said composite packages, allowing larger stacks to be formed with greater stability. Pallets of such composite packages may thus be assembled using less means for structural reinforcement of the pallet (e.g. plastic film wrapping or straps), while still maintaining sufficient structural integrity to be shipped and distributed to retailers and customers.

According to a further aspect, the invention is directed to an assembly, e.g. a stack, of composite packages as briefly described above.

Thanks to a compact shape of the composite packages according to the invention an assembly of such composite packages on a pallet contains more product(s) than in the prior art for the same overall external dimensions.

For instance, a pallet may contain up to 20% more product(s) than previously.

Also, a pallet of such composite packages is more stable than in the prior art, which renders the pallets thus configured more stackable.

DESCRIPTION OF THE EMBODIMENTS

The invention will be better understood from the description which follows, which relates to embodiments, given by way of non-limiting example, and explained with reference to the accompanying FIGS. 1-5, depicting a composite package composed of containers of differing shape and volume; an alternate form of a composite package including means for the interlocking of the individual containers; a cross-section of an alternate form of a composite package; a composite package including means for the interlocking of multiple identical composite packages; and a representation of two interlocking composite packages, respectively.

Figure 1:
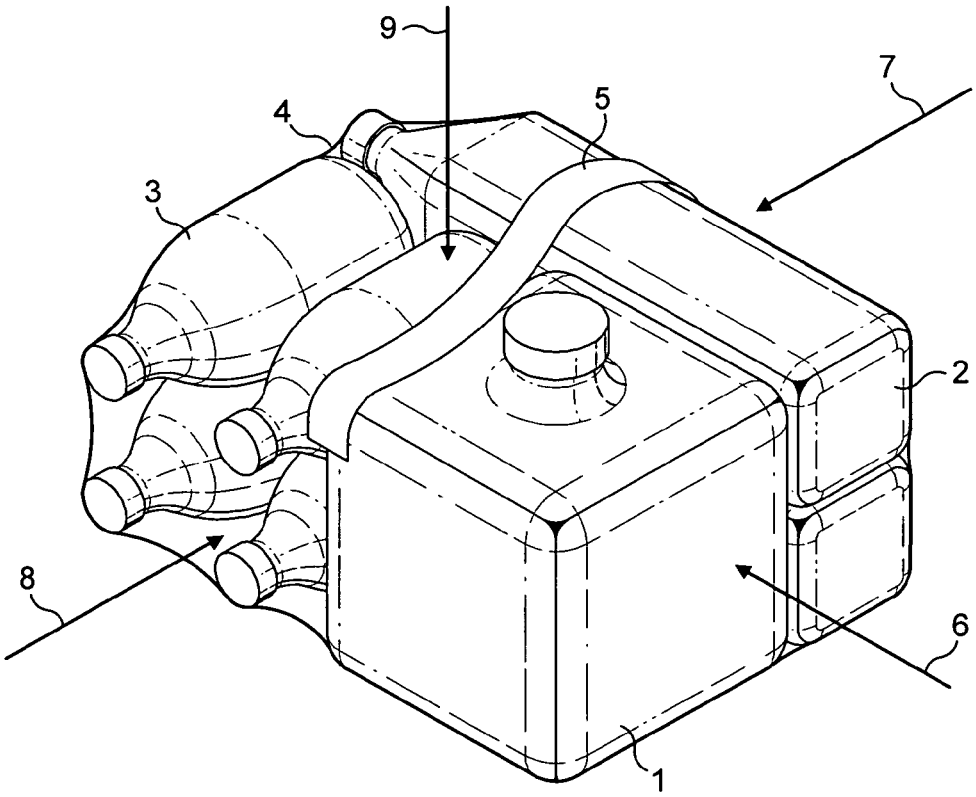
FIG. 1 is an isometric illustration of a preferred embodiment of a composite package comprised of multiple individual containers.

FIG. 1 depicts an embodiment for a composite package 8. The composite package 8 of FIG. 1 is comprised of one large-sized bottle 1, two medium-sized bottles 2, and four small-sized bottles 3. In the preferred embodiment, the large-sized bottle 1 is between 3 and 5 liters, intended for consumption such as at home by a family; the medium-sized bottles 2 are between 1 and 1.5 liters, intended for consumption during activities such as sport or travel; and the small-sized bottles 3 are between 0.5 and 1 liters, intended for consumption in situations where a compact container is desired, such as by a child at school. The containers are held in place by a packaging material, such as a wrap 4, preferentially fabricated from heat-shrink plastic film, which may optionally be decorated with labels, logotypes, etc. so as to give the consumer information about the containers within the composite package 8. It is to be noted that other kind of packaging material or binding means may be envisaged and in particular, cardboard, strapping links, sleeves, etc. A plastic handle 5 is also attached, preferably by means of an adhesive, to the composite package 8, permitting the consumer to lift and carry the composite package 8 more easily. For example, the handle is attached to the packaging material itself. Alternatively, the handle may be attached directly to at least one of the containers in the package.

The individual containers constituting the composite package 8 are oriented such that external forces applied upon the composite package 8 are borne by the sides of at least two containers. FIG. 1 depicts lateral loads 6 and 7. Lateral load 6 is borne primarily by the bodies of large-sized container 1 and the four small-sized containers 3, reducing the load exerted upon the closures and necks of the medium-sized containers 2. Likewise, lateral load 7 is borne primarily by the bodies of large-sized container 1 and the two medium-sized containers 2, reducing the load borne by the closures and necks of the small-sized containers 3. And in the same fashion, the vertical load 9 is borne primarily by the bodies of the medium-sized containers 2 and the small-sized containers 3, reducing the load borne by the neck and closure of the large-sized container 1. It is to be noted that the liquid, e.g. water, filling laying containers, e.g. laying bottles, may be used to support a load exerted on the composite package.

In another arrangement (not represented in the drawings) of individual containers within a composite package four containers arranged at the four corners of the package may play the role of pillars (e.g. four glass bottles) in order to provide better top load resistance to the package and, therefore, improve the overall stability of pallets of such composite packages.

The pillars may be formed by the heaviest and strongest bottles in a package of bottles, the lightest and weakest bottles being arranged in between.

When using pillars pouches or pouch-like containers may be used in a composite package between the stabilizing pillars.

Figure 2:
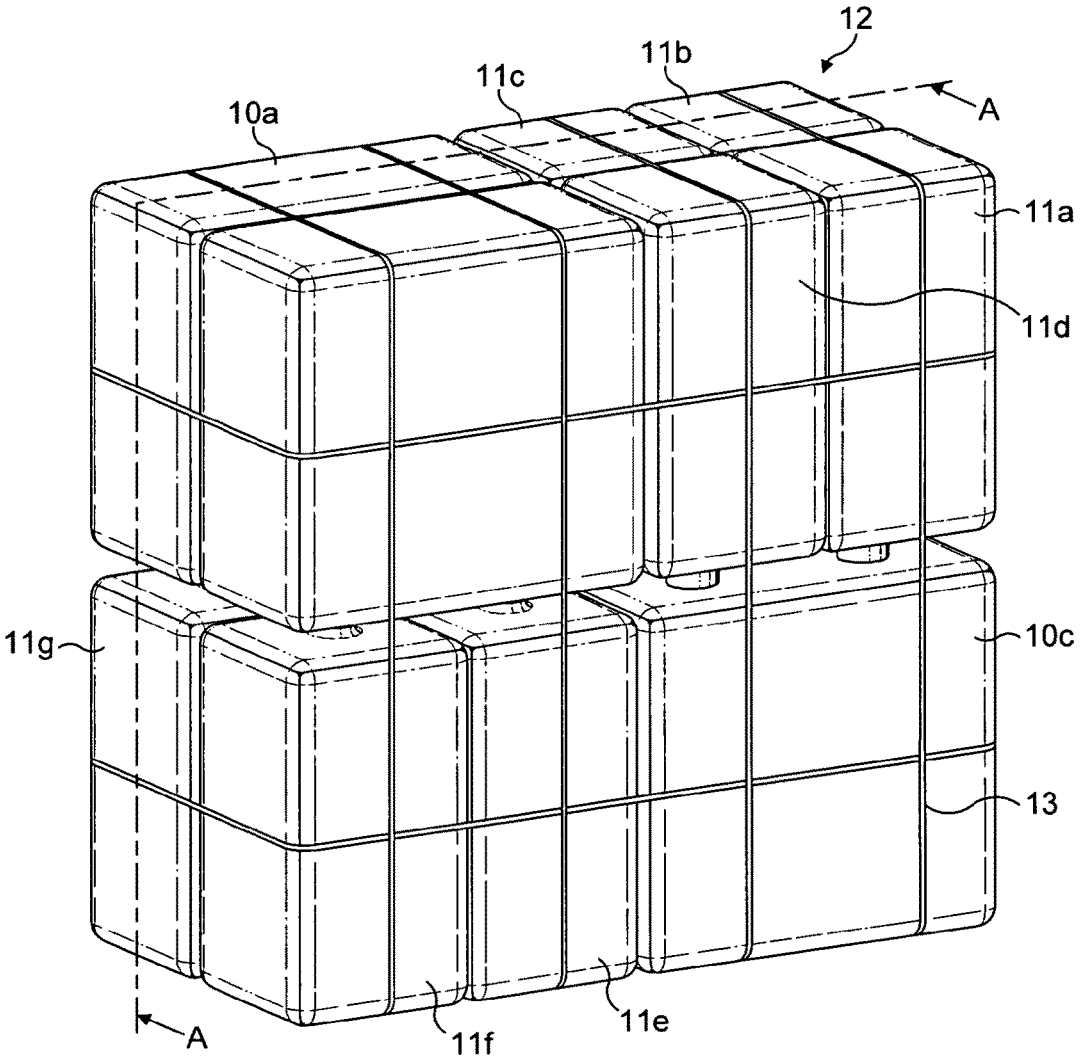
FIG. 2 is an isometric illustration of an alternate embodiment of a composite package comprised of multiple individual containers.
Figure 3:
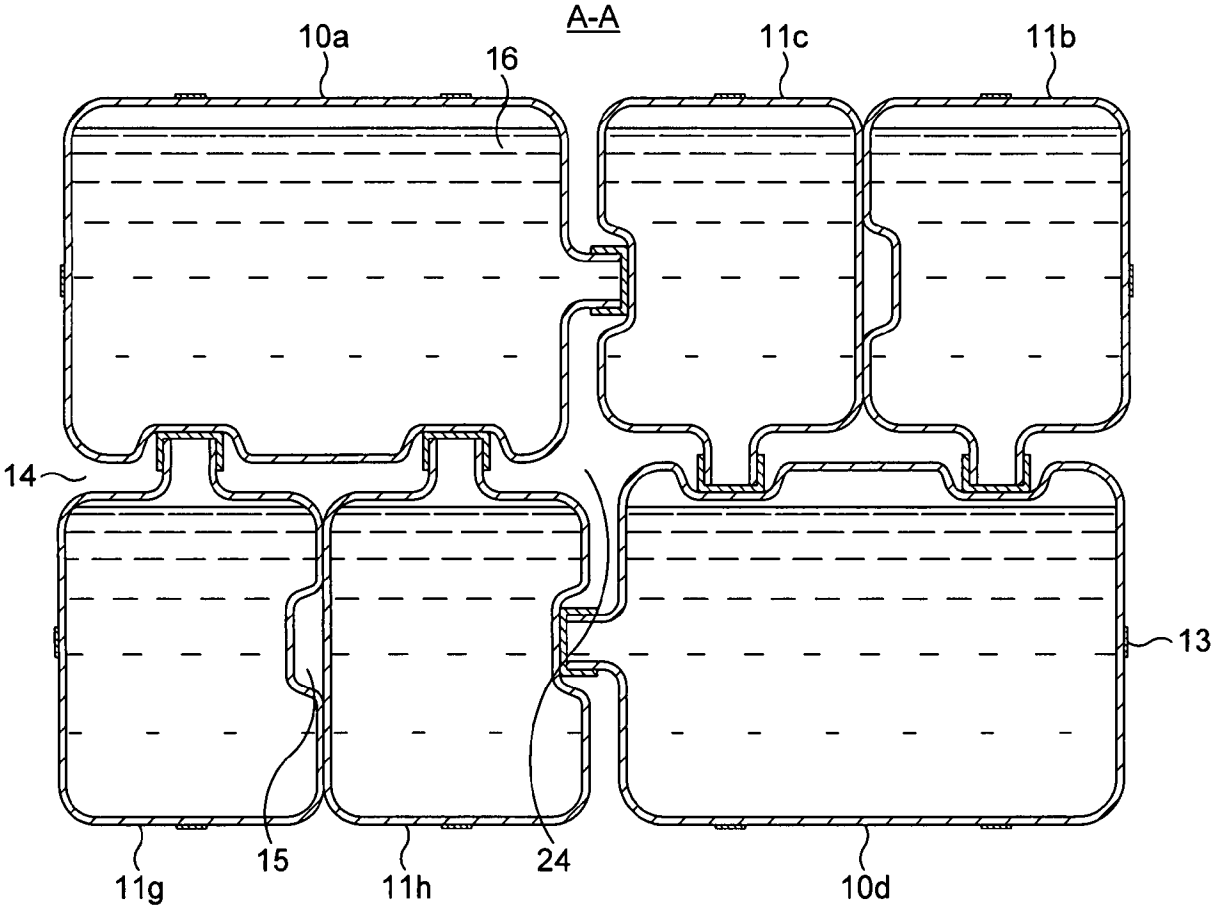
FIG. 3 is a cross-section of the alternate embodiment of a composite package through plane A-A as depicted in FIG. 2.

FIGS. 2 and 3 depict an alternative arrangement of individual containers within a composite package 12. The composite package 12 is comprised of four large-sized containers 10*a-d* and eight small-sized containers 11*a-h*. The composite package 12 is held together by means of packaging materials such as straps 13, which encircle the composite package 12 and provide it with structural rigidity.

FIG. 3 is a cross-sectional view of the composite package 12, taken through the section plane A-A as depicted in FIG. 2. The small-sized containers 10*a-d* and the large-sized containers 11*a-h* are filled with the liquid product 16. Both the small-sized containers 11*a-h* and the large-sized containers 10*a-d* are provided with recesses 15. The recesses 15 are of approximately the same diameter as the container caps 14, and positioned upon the containers 10*a-d* and 11 *a-h* such that the container caps 14 engage the recesses 15 when the containers 10*a-d* and 11*a-h* are assembled into the composite package 12. The composite package 12 is thus given additional structural rigidity by the interlocking between the container caps 14 and the recesses 15. Also, the interlocking of two individual containers along at least one direction or axis prevents or reduces relative motion between these containers in a perpendicular direction or axis. Preferably, the interlocking occurs along two different directions or axis, e.g. perpendicular to each other and thus forming an interlocking plane. The individual containers are therefore free to move along the direction that is perpendicular to this plane. For instance, the interlocking plane of a container may be perpendicular to the overall orientation of the container, depending on the location and orientation of the interlocking member(s) on the container.

Furthermore, the interlocking of the containers 10*a-d* and 11*a-h* creates an interstitial space 24, which may optionally be employed to contain other items to be sold along with the composite package. The interlocked individual containers 10*a*, 11*c*, 10*d* and 11*h* form a continuous, linked structure preventing, or at least reducing, any relative motion between the containers. By interlocking only some of the containers in the package in an appropriate fashion it is thus possible to hold in position the whole package or at least the containers defining the external enclosure of the package and that are interlocked. The interlocking between containers makes it possible to maintain the containers in a consistent position relative to each other.

The recesses 15 are arranged in the walls constituting the body of the containers. For example, the recesses are disposed in the side wall of the container's body. A large-sized container 10*a-d* may be provided with several recesses 15 (e.g. two) and a small-sized container 11*a-h* may be provided with one recess 15. The number and location of the recesses 15 may vary as a function of the dimensions of the containers relative to each other and their spatial arrangement within the package. For instance, one or several recesses may be provided in the bottom wall of a container in case the cap of one or several containers is in contact with the bottom wall of another container. It is to be noted that the caps 14 and recesses 15 are male and female interlocking members, respectively. Depending on the size, shape, and weight of the containers involved, other means or members, such as tab-and-slot interfaces, locating pins, etc. may alternately be employed.

Figure 4:
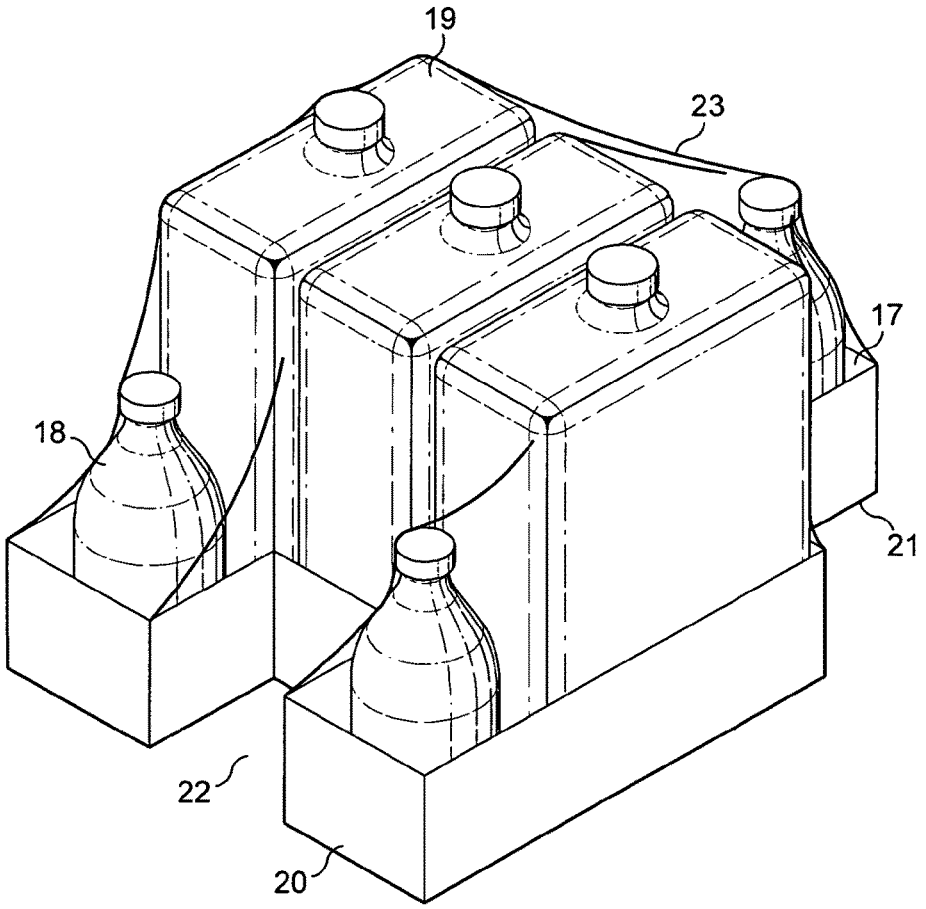
FIG. 4 is an isometric illustration of a composite package including means for the interlocking of multiple, substantially identical, composite packages.

FIG. 4 depicts an alternate embodiment of a composite package 17 that is configured so as to enable a quantity of such packages to interlock when arranged together in an assembly, e.g. stack, of several composite packages. The composite package 17 depicted in FIG. 4 is comprised of three small-sized containers 18 and three large-sized containers 19. The containers are situated in a tray 20, which serves to maintain the containers in a consistent position relative to each other. This tray might be replaced by an alternative maintaining structure that limitates relative motion between the individual containers. The tray 20 is preferably fabricated from paperboard or cardboard, but may be fabricated from any material of sufficient strength, durability, and low cost. The composite package 17 is further provided with a packaging material such as a plastic film wrap 23, e.g. a shrink film with holes, which seals the containers 18 and 19 and the tray 20, holds the containers 18 and 19 in place, and gives additional structural strength to the composite package 17. Other types of binding means may be used such as strapping links which leave empty spaces where needed.

Figure 5:
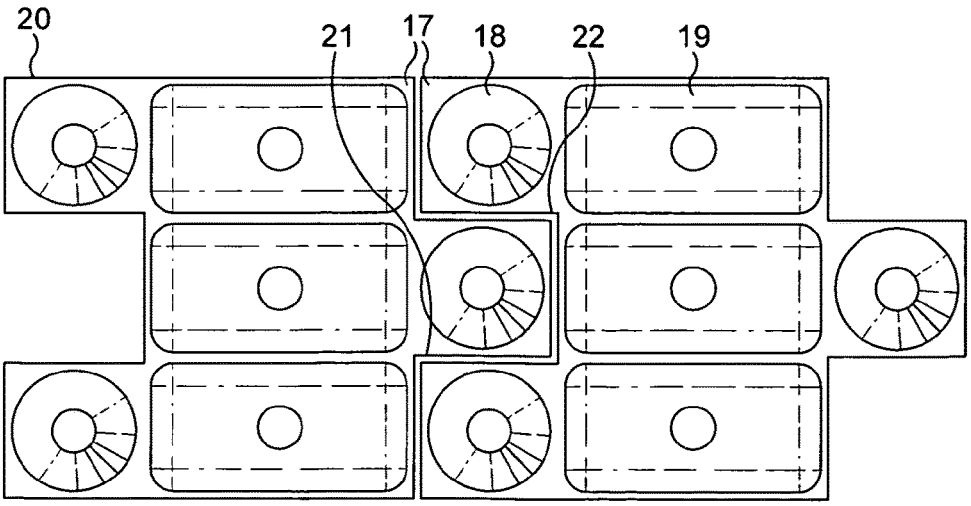
FIG. 5 is a schematic view of two of the composite packages of FIG. 4, positioned relative to one another so as to be interlocking.
Figure 6:
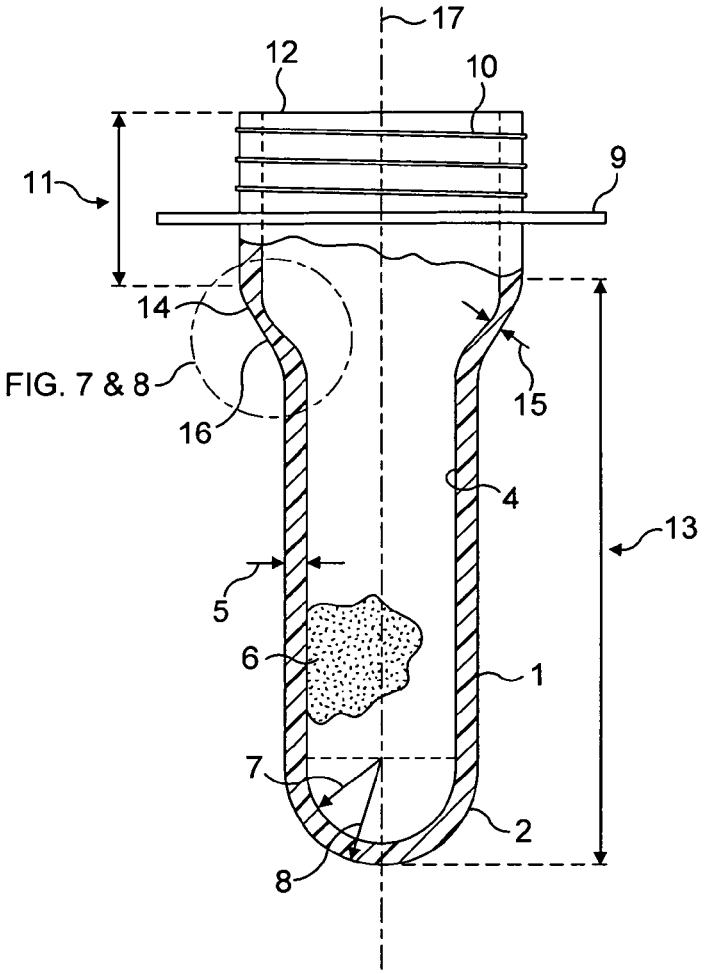
Figure 7:
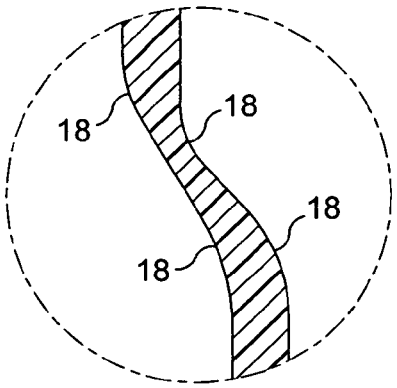
Figure 8:
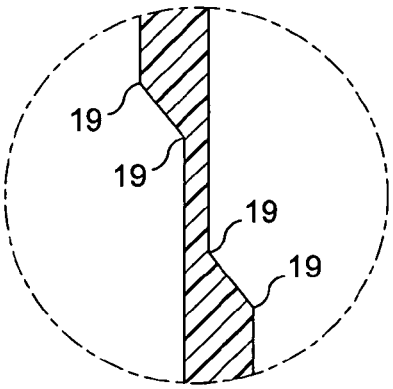
Figure 9:
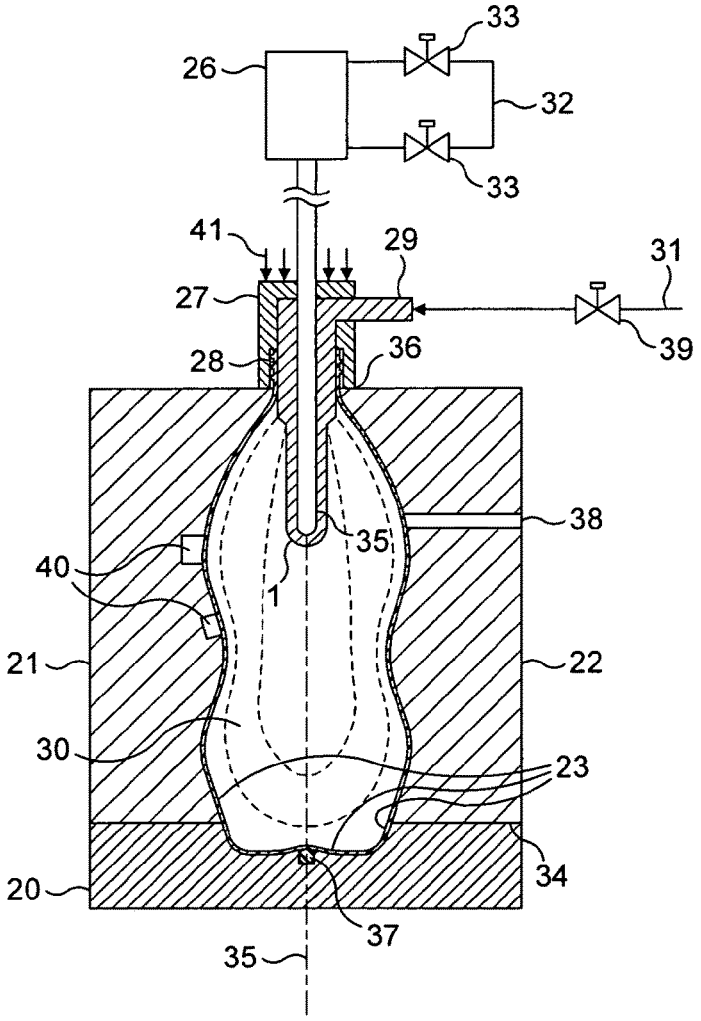
Figure 10:
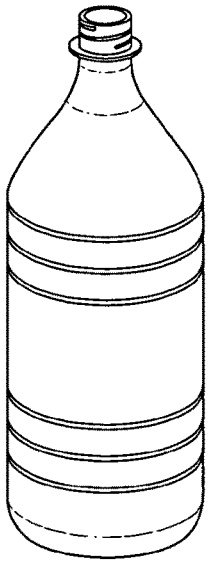
Figure 11:
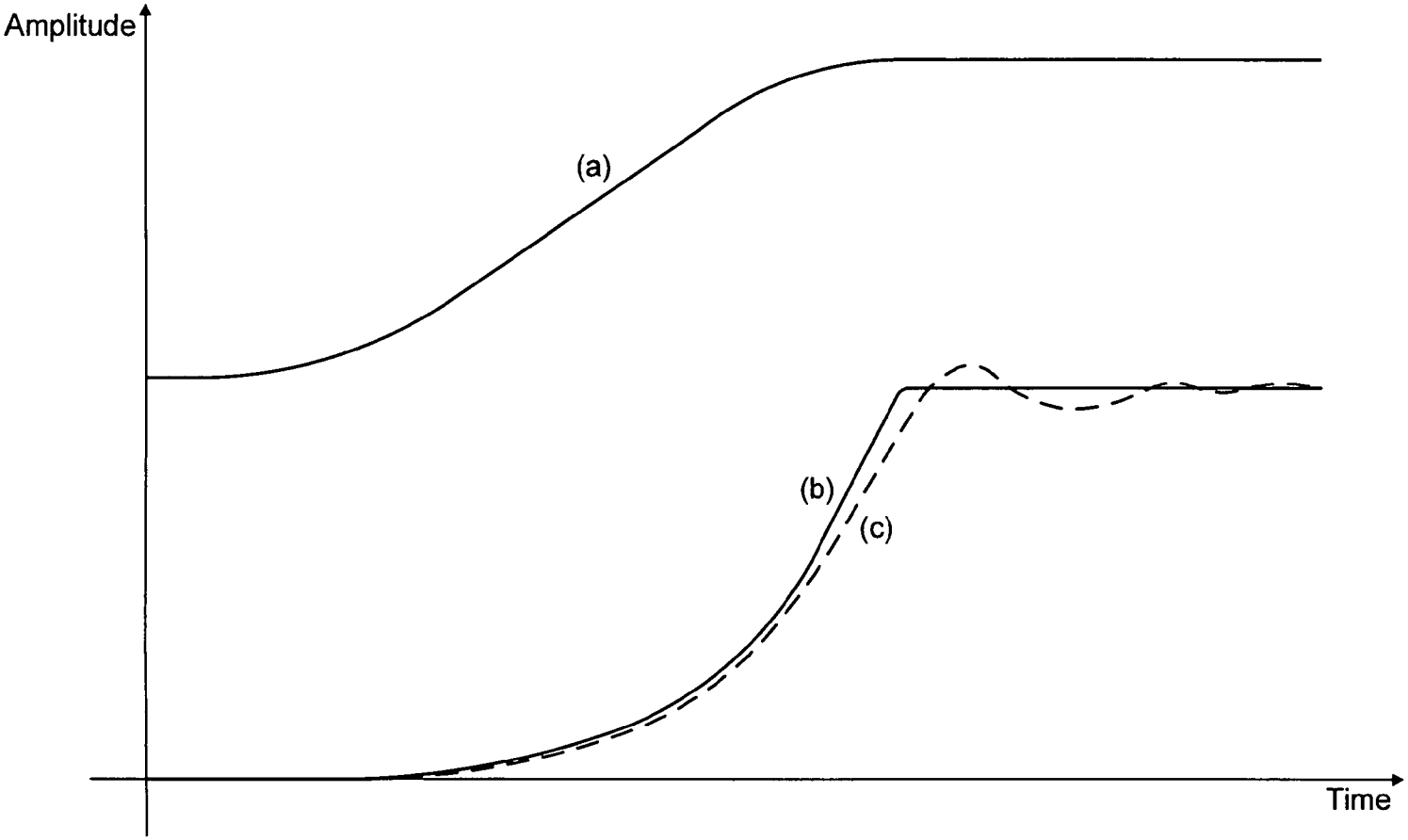

The composite package 17 of FIG. 4 is further provided with means for the interlocking of several such composite packages. Specifically, the composite package 17 is provided with a tongue 21 and a slot 22. FIG. 5 depicts the interlocking of two such composite packages 17 as viewed from above. The tongue 21 (male interlocking member) of the composite package 17 to the left engages with the slot 22 (female interlocking member) of the composite package 17 to the right, forming a mechanical interface between the two. When a plurality of composite packages 17 are arranged in such an array or assembly, the interface between them gives additional strength to the array. For instance, an array of composite packages 17 stacked upon a pallet would be more resistant to laterally-applied loads, reducing the likelihood that the stack may shift and collapse. This in turn makes the pallet safer to transport and store, and reduces the need for (and eventual waste generated by) the use of bindings such as strapping or plastic film wrap to ensure the structural integrity of the stack of composite packages 17. It is to be noted that other male and female interlocking members may be used to ensure interlocking of two or more composite packages.

In a general manner, whatever the embodiment a composite package according to the present invention may optionally use a mix of different materials for the containers it is composed of. Mix of different materials for different containers may be selected based on the role played by the containers within the composite package.

In particular, a container serving as a pillar in a composite package has preferably to be made of rather a rigid and strong material.

Glass and PET containers or cans and PET containers are non-limiting examples of mix of materials in a composite package of containers.

Furthermore, by making a composite package both rigid and soft it is possible to use less packaging material than previously.

For instance, a current six-pack of 1.5 liter bottles has an overall weight of 196 g of which 186 g represents the bottles weight (for 9 liters) and 10 g for the film used as a packaging material.

Thanks to the present invention the overall weight may be significantly reduced to 141 g of which 132 g represents the bottles weight and 9 g for the binding film.

More particularly, the composite package leading to such a result may be configured as follows: four 1 liter containers disposed at the four corners of the package and serving as pillars, each container weighing 18 g, and ten 0.5 liter containers arranged between the pillars with different shapes and orientations and weighing each 6 g.

Thus, the overall weight reduction may lie within the range between 5 and 40%.

The film reduction may be between 1 and 20%.

Combining rigid and soft containers within a composite package makes it possible to have refillable containers, e.g. the less rigid ones, which may be refilled by the most rigid ones which are less easy to handle. The latter are thus preferably used as pillars and sources of refilling for the other containers.

Combining rigid and soft containers within a composite package in a compact shape grants stability and rigidity to the resulting package.

Of course, the invention is not limited to the embodiment described above and shown in the accompanying drawings. Modifications remain possible, particularly as to the construction of the various elements or by substitution of technical equivalents, without thereby departing from the scope of protection of the invention. Accordingly, the scope of this disclosure is intended to be exemplary rather than limiting, and the scope of the invention is defined by any claims that stem at least in part from this disclosure.

The invention claimed is:

1. A composite package comprising:

a plurality of individual containers linked together into a single unit, the plurality of individual containers being of varying shapes and/or volumes, comprising at least one first container, at least two second containers, and at least one third container, each of the individual containers defining (1) a neck having an opening, (2) a main axis passing through the opening, and (3) a lateral side extending substantially parallel to the main axis, and each of the individual containers oriented such that all external loads applied upon the composite package parallel to the main axis of the first, second, or third container are borne primarily by the lateral sides of at least two of the individual containers, wherein the at least one first container of a first size is oriented in a first direction in the composite package to bear a load applied to the composite package in the first direction, the at least two second containers of a second size are oriented substantially perpendicular to the at least one first container to bear a load applied to the composite package in a second direction, the at least one third container is oriented substantially perpendicular to the at least one first container to bear a load applied to the composite package in a third direction, the first size is larger than the second size, and the second size is larger than the third size.

2. The composite package according to claim 1, wherein the package comprises a packaging material that binds the individual containers together into a single unit.

3. The composite package according to claim 1, wherein the package is held together by a packaging material.

4. The composite package according to claim 1, wherein the weight of at least some of the individual containers is borne by other individual containers within the composite package.

5. The composite package according to claim 1, comprising one large-sized container, two medium-sized containers, and four small-sized containers, wherein the one large-sized, two medium-sized, and four small-sized containers are oriented such that all of the external loads applied upon the composite package parallel to the main axis of the first, second, or third container are borne primarily by the lateral sides of at least two containers.

6. The composite package according to claim 1, wherein the first container comprises four lateral sides, and all of the lateral sides of the first container are planar.

* * * * *